US012564233B1

(12) United States Patent
Morris

(10) Patent No.: US 12,564,233 B1
(45) Date of Patent: Mar. 3, 2026

(54) HAIR EXTENSIONS STAPLER

(71) Applicant: Kiesha Morris, Toronto (CA)

(72) Inventor: Kiesha Morris, Toronto (CA)

( * ) Notice: Subject to any disclaimer, the term of this patent is extended or adjusted under 35 U.S.C. 154(b) by 0 days.

(21) Appl. No.: 18/954,861

(22) Filed: Nov. 21, 2024

(51) Int. Cl.
*A41G 5/00* (2006.01)

(52) U.S. Cl.
CPC ..... *A41G 5/0086* (2013.01); *A41G 5/0073* (2013.01)

(58) Field of Classification Search
CPC .. A41G 5/0013; A41G 5/0026; A41G 5/0053; A41G 5/0073; A41G 5/0086; A61B 17/068; B25C 5/00; B25C 5/02; B25C 5/025; B25C 5/0235; B25C 5/0292
See application file for complete search history.

(56) References Cited

U.S. PATENT DOCUMENTS

| | | | | |
|---|---|---|---|---|
| 5,451,231 | A * | 9/1995 | Rabenau | A61B 17/076 81/381 |
| 8,365,743 | B2 * | 2/2013 | Stotts | A41G 5/0086 132/112 |
| 8,726,821 | B2 | 5/2014 | White et al. | |
| 8,746,257 | B1 | 6/2014 | Holmes | |
| 10,743,598 | B2 | 8/2020 | Harris | |
| 10,779,595 | B1 * | 9/2020 | Hurst | A41G 5/0086 |
| 11,357,311 | B2 | 6/2022 | Smith | |
| 11,571,034 | B2 | 2/2023 | Stuart-Richards | |
| 2001/0008065 | A1 * | 7/2001 | Sloan | A01K 13/00 54/1 |
| 2005/0247326 | A1 * | 11/2005 | Park | A41G 5/0066 132/201 |
| 2009/0120993 | A1 * | 5/2009 | Kandasamy | B25C 5/11 227/134 |
| 2011/0178466 | A1 * | 7/2011 | Vioreanu | A61B 17/0682 604/174 |
| 2014/0230838 | A1 | 8/2014 | Reed | |
| 2017/0119123 | A1 * | 5/2017 | Sanders | A41G 5/0086 |
| 2018/0116324 | A1 * | 5/2018 | Harris | A41G 5/0066 |
| 2020/0060370 | A1 | 2/2020 | Frieman | |
| 2024/0157031 | A1 * | 5/2024 | Yadav | A61L 31/16 |

* cited by examiner

*Primary Examiner* — Rachel R Steitz
*Assistant Examiner* — Karim Asqiriba

(57) ABSTRACT

A hair extensions stapler is provided. The hair extensions stapler includes a housing with a head at one end and a handle at the other. The head includes a collection area for securing hair, and the handle is equipped with a lever arm that actuates a stapling mechanism. The hair extensions stapler includes a cartridge capable of holding hypoallergenic and heat-resistant staples made from titanium and copper alloy. The staples transition from a "C" shape to an "O" shape upon actuation, securely attaching weft hair extensions to cornrows. The hair extensions stapler provides an efficient alternative to traditional needle and thread methods, reducing installation time, minimizing hair damage, and simplifying maintenance and removal processes.

12 Claims, 6 Drawing Sheets

HAIR EXTENSIONS STAPLER

BACKGROUND OF THE INVENTION

The present invention relates to the field of hair extensions and, more specifically, to devices used for attaching weft hair extensions to natural hair. Hair extensions have become an increasingly popular method for enhancing the length, volume, and style of natural hair.

Traditionally, the process of attaching hair extensions has been labor-intensive and time-consuming, most notably through the widely used method of sewing weft extensions onto cornrows using a needle and thread. While this method has been used in the industry for some time, it is not without its shortcomings. One of the primary issues with the needle and thread method is the significant amount of time it requires to attach the hair extensions. A professional hairstylist may spend hours meticulously threading and sewing the wefts into place. This lengthy process can be inconvenient for both the stylist and the client. Additionally, the needle and thread technique present a number of risks to the client's natural hair. The pulling and tension caused by threading can lead to hair breakage and scalp irritation. This can result in long-term damage, particularly for clients with fine or fragile hair. Moreover, removing the sewn-in extensions can be challenging, as cutting the threads without damaging the natural hair is difficult and requires great care.

Existing methods also fail to offer an easily reversible solution. For clients who desire the ability to quickly change hairstyles or maintain their natural hair without prolonged downtime, the needle and thread technique is limiting. Removal of sewn-in wefts for purposes such as washing, trimming, or scalp treatment can be difficult, adding further strain to both the natural hair and the client's time. The permanent nature of these sewn wefts can also be uncomfortable, with clients reporting headaches or discomfort when the extensions are worn for extended periods, especially during sleep.

In response to these challenges, some hair extension attachment methods have attempted to address the issues of time and hair safety, such as clip-in extensions. While these offer a temporary solution, they often lack the security and durability of sewn-in extensions and can detach easily during normal wear. Other attachment methods, such as glue or tape-based techniques, introduce chemicals that may cause scalp irritation or further damage the hair, while still requiring significant time and skill to apply properly.

Thus, there is a clear need for a hair extension attachment method that combines the security and durability of sewn-in extensions with the speed and ease of application offered by other methods. The invention described herein aims to solve these problems by providing a handheld hair extensions stapler that allows for a quick, efficient, and safe attachment of weft hair extensions to natural hair. The device offers a hypoallergenic, staple-based method of securing extensions, that significantly reduces the time required for installation and removal while protecting the integrity of the natural hair.

In light of the devices disclosed in the known art, it is submitted that the present invention substantially diverges in design elements and methods from the known art and consequently it is clear that there is a need in the art for an improvement for a hair extensions stapler for attaching weft hair extensions to natural hair. In this regard the instant invention substantially fulfills these needs.

SUMMARY OF THE INVENTION

In view of the foregoing disadvantages inherent in the known types of hair extension stapler now present in the known art, the present invention provides a hair extension stapler that comprises a handheld device with a housing that includes a collection area for positioning the hair, a handle for actuating the stapling mechanism, and a cartridge capable of holding multiple staples. The staples transition from an open "C" shape to a closed "O" shape upon discharge, securely fastening the weft extension to the natural hair.

It is an objective of the present invention to offer a safer and less damaging method of attaching weft hair extensions to natural hair by utilizing a collection area within a head of the stapler. This collection area is designed to securely hold both the weft extension and the natural hair in place, while the staple's unique design transitions from a "C" shape to an "O" shape upon actuation, ensuring a secure attachment without exerting excessive tension that can lead to scalp irritation or hair breakage.

It is an objective of the present invention to provide hypoallergenic, heat-resistant, and x-ray safe staples that are loaded into the hair extensions stapler's stainless steel cartridge. The use of titanium and copper alloy staples ensures that clients can safely wear extensions even in environments exposed to heat or during medical imaging procedures, while the cartridge mechanism allows for smooth, precise advancement of the staples during each use.

It is an objective of the present invention to provide a hair extensions stapler that significantly reduces installation time by incorporating a cartridge system that holds up to 75 staples. This allows for rapid, continuous stapling without the need for frequent reloading, thereby enabling faster weft hair extension attachment compared to the traditional needle and thread method.

It is an objective of the present invention to offer an ergonomic, ambidextrous handle that reduces user fatigue during prolonged use. The handle is made from a soft, durable gel material that allows for a comfortable grip, while the symmetrical design ensures that both left- and right-handed users can operate the stapler with equal ease, improving accessibility and user experience in professional salons.

It is an objective of the present invention to provide a hair extensions stapler with a head that is designed to receive a group of hair to be stapled. The geometry of the head features opposing faces that easily align the weft hair extension and natural hair in a collection area, ensuring precise grouping and stapling in the desired location, reducing the likelihood of misalignment or improper attachment.

It is an objective of the present invention to provide a lever mechanism that enables one-handed operation of the hair extensions stapler. This lever design allows the user to apply a squeezing force with minimal effort, actuating the stapling process while leaving the other hand free to position the hair, thus improving efficiency and ease of use for professional stylists during hair extension installations.

It is therefore an object of the present invention to provide a new and improved hair extensions stapler that has all of the advantages of the known art and none of the disadvantages.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
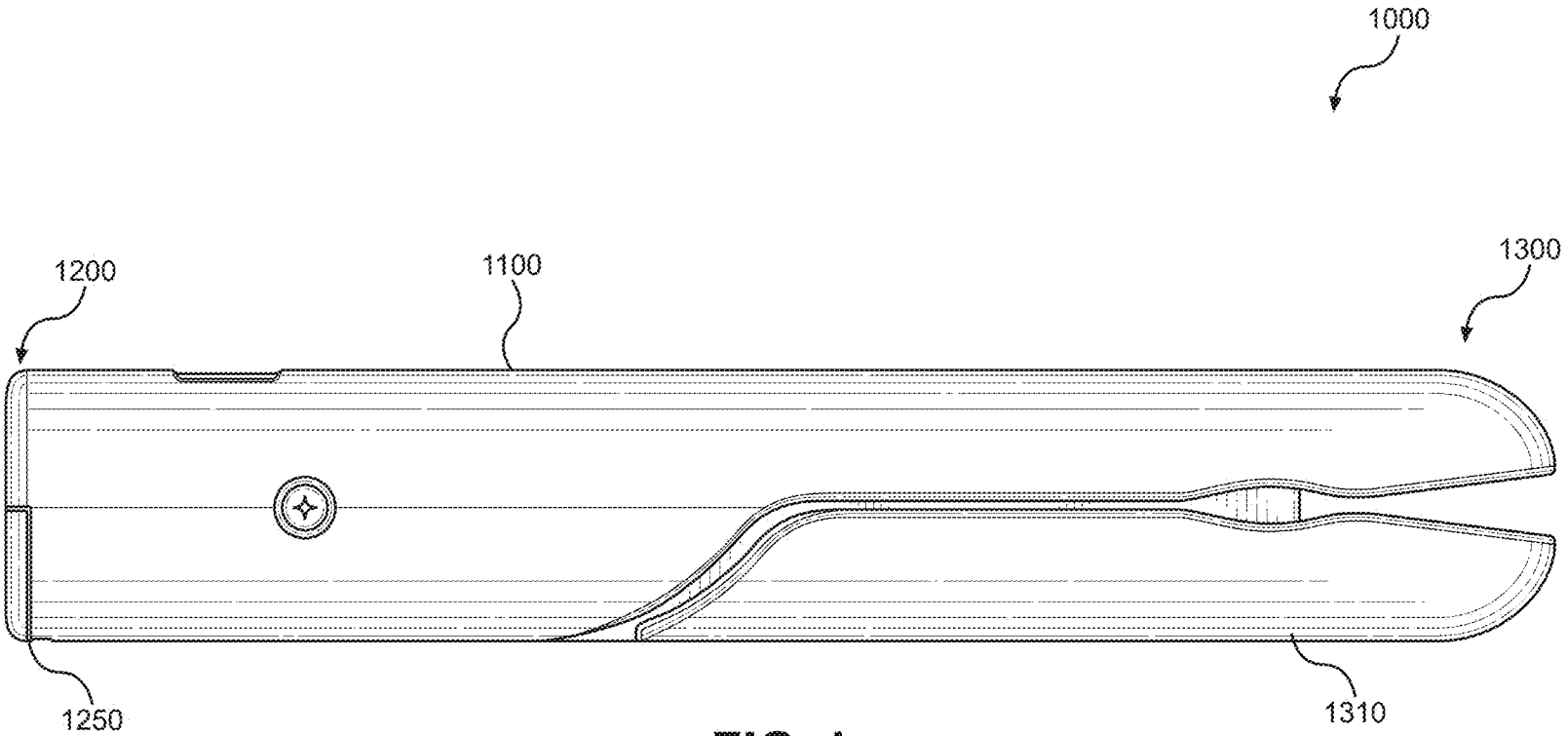
FIG. 1 shows a side elevation view of one embodiment of the hair extensions stapler.

Reference is made herein to the attached drawings. Like reference numerals are used throughout the drawings to depict like or similar elements of the hair extensions stapler. For the purposes of presenting a brief and clear description of the present invention, the preferred embodiment will be discussed as used for attaching weft hair extensions to natural hair. The figures are intended for representative purposes only and should not be considered to be limiting in any respect.

As used herein, the term "hair extensions stapler" refers to any device designed to secure weft hair extensions to natural hair using staples. The stapler described herein utilizes a staple-based attachment system, replacing traditional needle-and-thread methods. The device is intended for use by professional hair stylists or individuals proficient in attaching weft hair extensions, and can be used in various settings where quick, safe, and durable attachment is desired. As used herein, the term "staples" refers to small metal fasteners that deform during the stapling process to secure two or more materials together, providing a safe, durable, and hypoallergenic connection between hair extensions and natural hair.

Referring now to FIGS. 1 and 2, there is shown a side elevation view of one embodiment of the hair extensions stapler and an exploded view of the hair extensions stapler, respectively. The hair extensions stapler 1000 is configured for use by professional hair stylists or individuals proficient in attaching weft hair extensions. The hair extensions stapler 1000 includes a housing 1100 having a head 1200 positioned at the first end of the housing 1100, and a handle 1300 positioned at the second end. The head 1200 comprises a collection area 1250 formed between two opposing faces 1251, 1252, which are designed to receive a group of natural hair and a weft hair extension. The collection area 1250 funnels the hair for the stapling process, separating the selected hair from the rest, and thereby ensuring accurate placement of the staples in the desired location.

In the shown embodiment, the handle 1300 includes a lever arm 1310 configured to actuate the stapler when squeezed by the user. Upon squeezing the lever arm 1310, the internal mechanism of the hair extensions stapler 1000 is engaged, discharging a staple from the staple cartridge 1400 located inside the housing 1100. The staple is driven toward an anvil positioned at the forward end of the head 1200, deforming the staple from its initial "C" shape into a closed "O" shape. This deformation securely fastens the weft hair extension to the natural hair positioned within the collection area 1250, ensuring a precise and durable attachment.

Figure 2A:
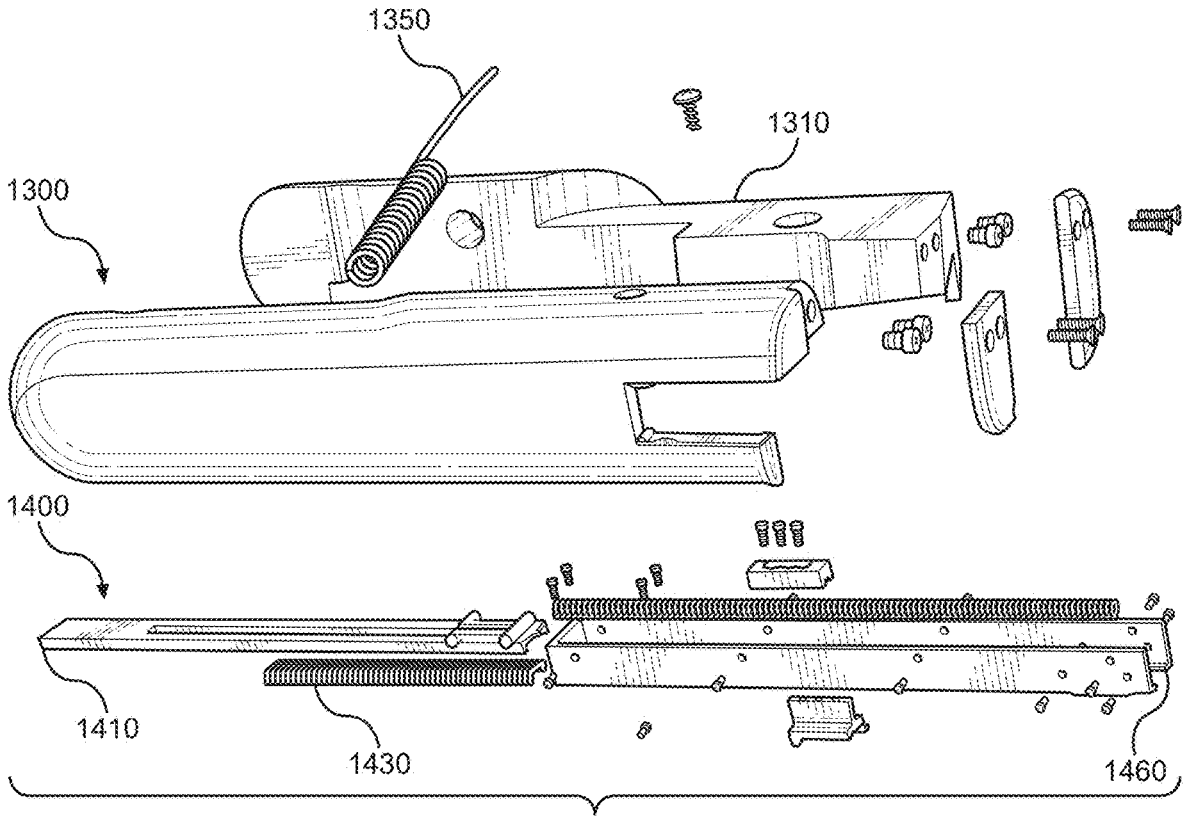
FIG. 2A shows an exploded view of one embodiment of the hair extensions stapler.
Figure 2B:
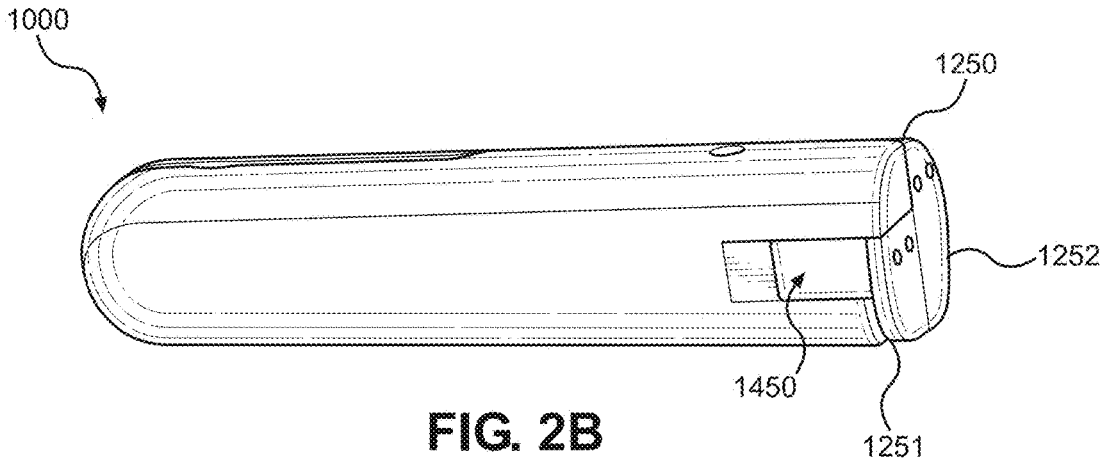
FIG. 2B shows a perspective view of an assembled embodiment of the hair extensions stapler of FIG. 2A.

Referring now to FIGS. 2A and 2B, there is shown an exploded view of the hair extensions stapler, illustrating the components of the stapler in greater detail, and a perspective view of an assembled embodiment of the hair extensions stapler of FIG. 2A, respectively. The housing 1100 encloses the internal mechanisms, including the staple cartridge 1400, a pusher mechanism 1410, and a spring 1420. The staple cartridge 1400 is designed to hold multiple staples 1430 arranged in a linear configuration within a channel. The pusher mechanism 1410 is spring-loaded and advances the staples 1430 toward the anvil in the head 1200 for discharge upon actuation of the lever arm 1310. The housing 1100 further includes a cartridge receiving compartment 1450, which is designed to accommodate the staple cartridge 1400. The cartridge 1400 is inserted into the compartment 1450 via a side-loading or top-loading mechanism, depending on the specific configuration of the stapler. The cartridge 1400 and loading mechanism are shown in FIGS. 3-5.

Figure 3:
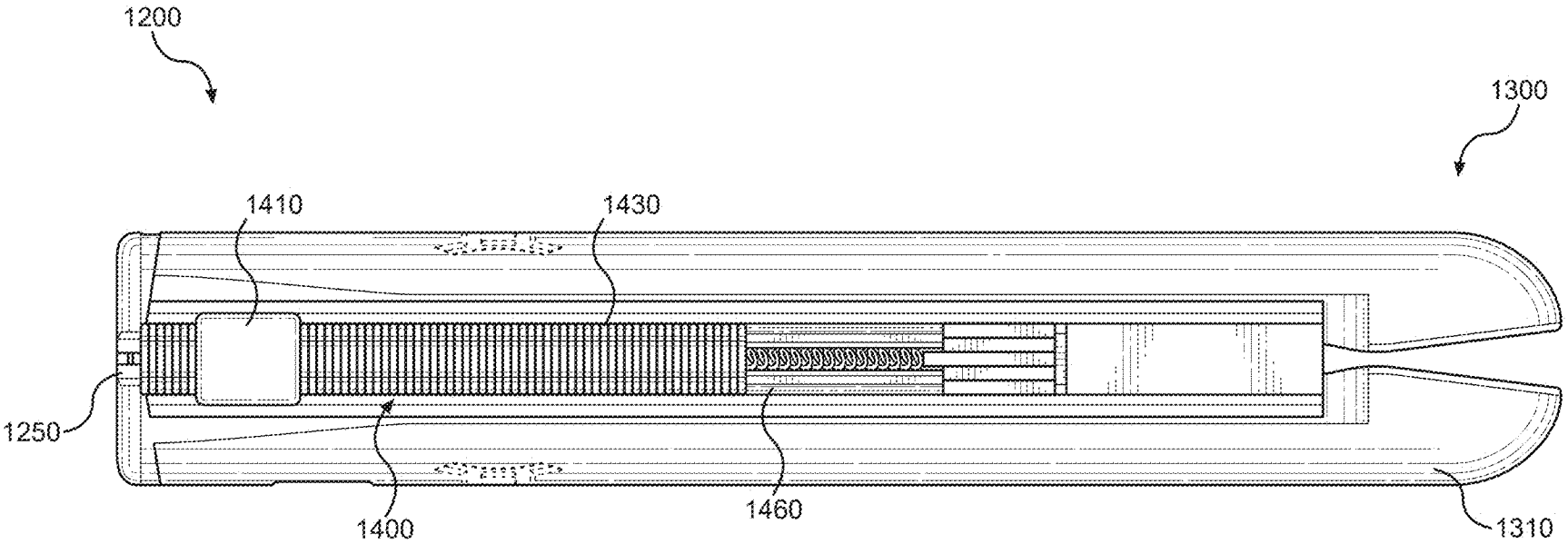
FIG. 3 shows a cross-sectional view of one embodiment of the hair extensions stapler of FIG. 1.
Figure 4:
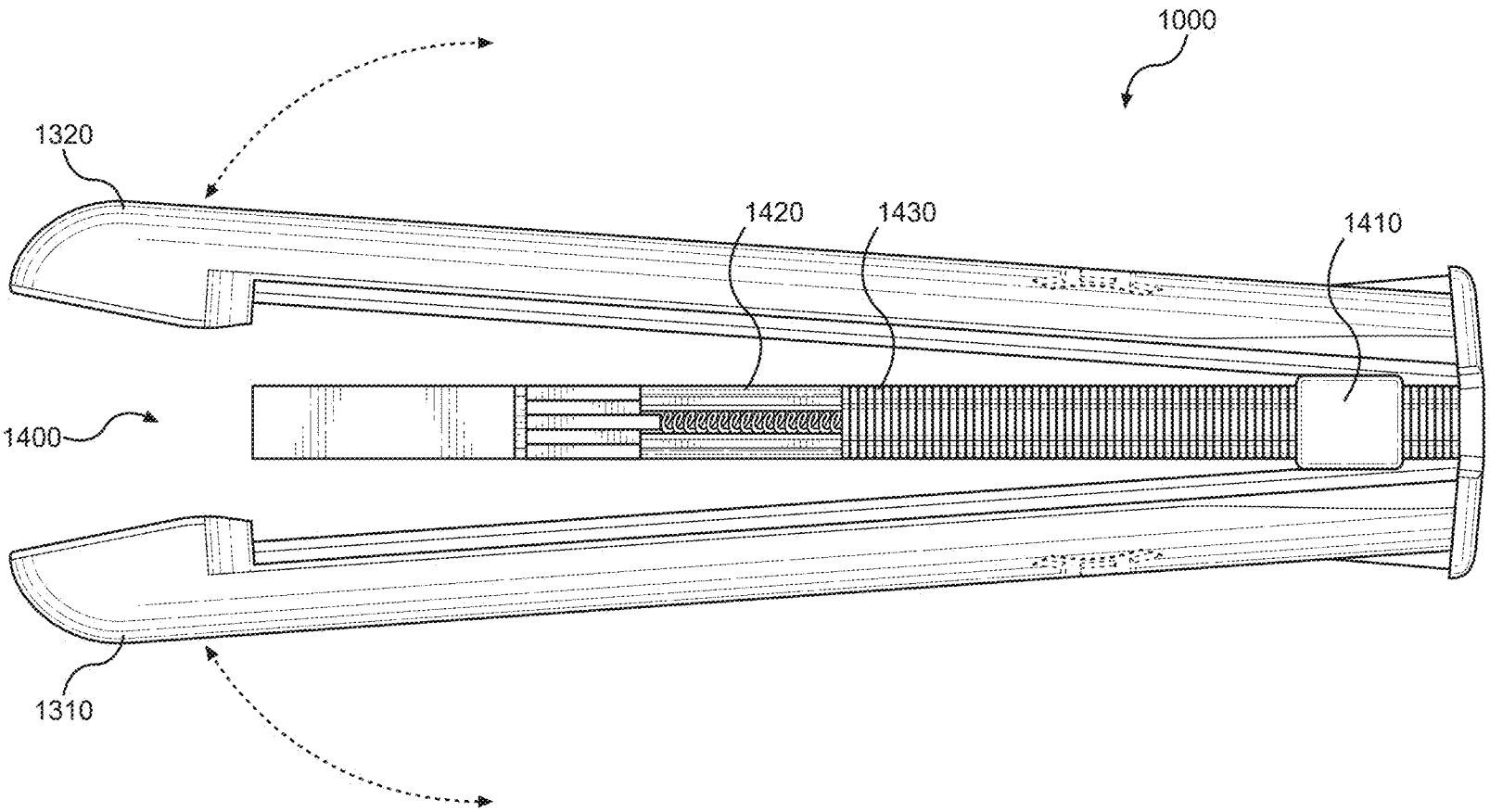
FIG. 4 shows a perspective view of an embodiment of the hair extensions stapler.
Figure 5:
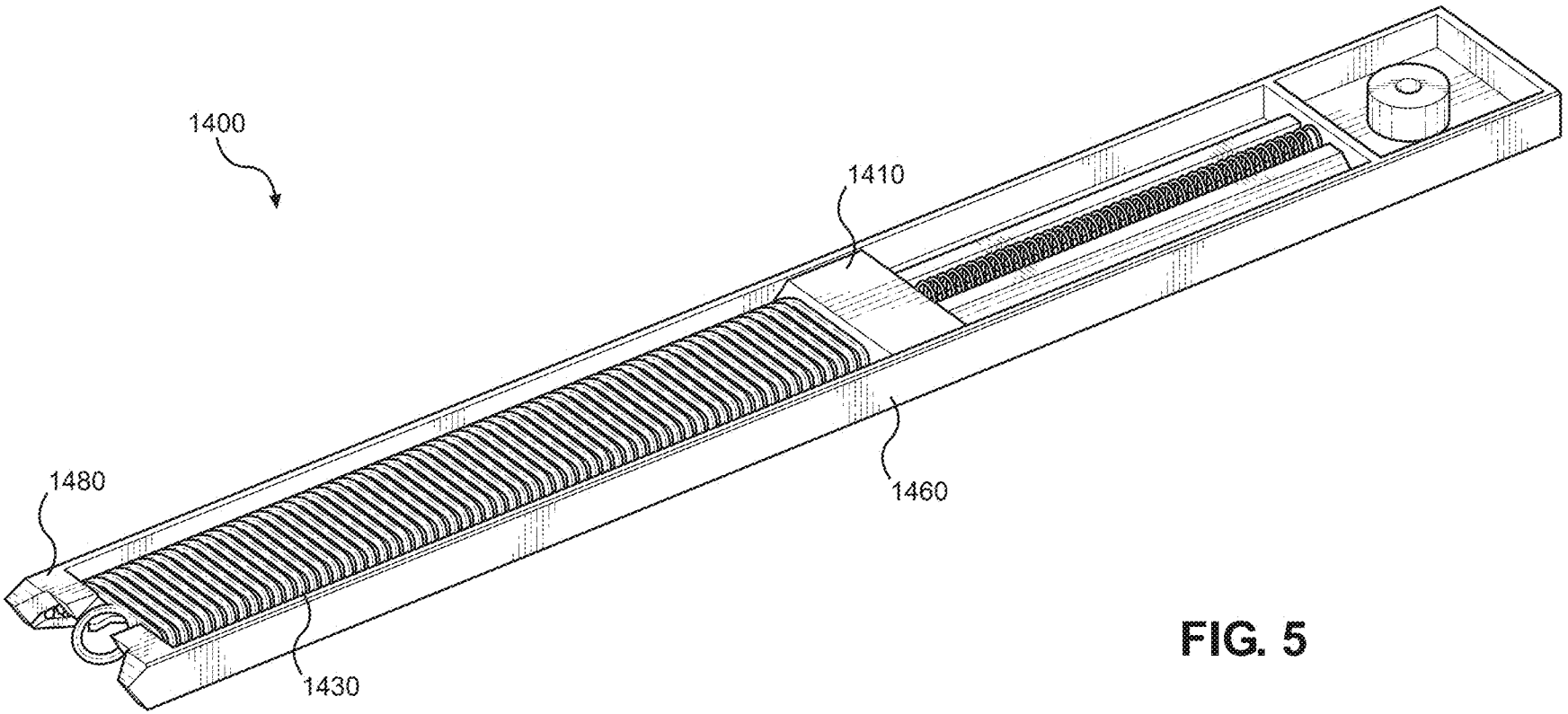
FIG. 5 shows an overhead view of one embodiment of the hair extensions stapler.

Referring now to FIGS. 3 and 4, there is shown a cross-sectional view of the hair extensions stapler of FIG. 1 and a perspective view of the staple cartridge used in the hair extensions stapler, respectively. The staple cartridge 1400 is positioned inside the cartridge receiving compartment 1450 within the housing 1100, where it is securely held in place during operation. In the shown embodiment, the cartridge 1400 is loaded with a plurality of staples 1430, arranged in a linear configuration along a channel 1460. In this arrangement, each staple 1430 is adapted to be advanced sequentially toward the head 1200 upon actuation and discharge of the leading staple.

In the shown embodiment, the pusher mechanism 1410 is spring-loaded and configured to bias the staples 1430 forward towards the head 1200 when loaded therein. The pusher mechanism continuously moves the staples forward within the channel 1460 via a spring 1420. The spring 1420, positioned at the rear of the cartridge 1400, is pre-compressed to bear against the pusher mechanism 1410, applying constant pressure to the staples and advancing them toward the front of the stapler for discharge. Additionally, the handle 1300 includes a spring mechanism 1350 (shown in FIG. 2) within the lever arm 1310 that automatically returns the lever to its original position after each actuation. This automatic reset function allows for rapid and repeated stapling without manual resetting by the user.

Referring specifically to FIG. 4, the staple cartridge 1400 is configured for easy removal and insertion into the housing 1100. An empty cartridge can be selectively removed and replaced with a fully loaded cartridge, enabling continued use of the stapler. Alternatively, the cartridge 1400 may be manually reloaded with individual staples 1430, allowing for extended use without full cartridge replacement. In some embodiments, the staples 1430 may be non-fixedly joined for convenient loading into the cartridge 1400. The cartridge 1400, in one embodiment, is constructed from durable materials such as stainless steel and/or hard plastic and is configured to hold multiple staples in a linear arrangement along the channel 1460. The pusher mechanism 1410 continuously advances the staples 1430 toward the head 1200 for discharge as each staple is engaged.

The pusher mechanism 1410, positioned at the rear of the cartridge 1400, is connected to a spring 1420 that provides the necessary tension to continuously advance the staples 1430 toward the anvil 1480. This design ensures consistent and efficient operation of the stapler, with each staple properly aligned and discharged in sequence. The spring mechanism 1420 maintains a steady flow of staples, preventing jamming and ensuring that the staples are advanced smoothly toward the head 1200 for secure attachment of the weft hair extension to the natural hair.

Referring now to FIG. 5, there is shown a perspective view of the staple cartridge 1400 used in the hair extensions stapler. The staple cartridge 1400 is a removable, replaceable component designed to house multiple staples 1430, arranged in a linear configuration within a channel 1460. The cartridge 1400 is configured for easy insertion into the cartridge receiving compartment 1450 of the stapler housing 1100 and is secured in place during operation.

The staple cartridge 1400 is constructed from durable materials such as stainless steel, hard plastic, or a combination of these materials, ensuring both longevity and structural integrity during use. The cartridge 1400 is designed to hold a plurality of staples 1430, which are aligned sequentially along the channel 1460. Each staple 1430 is positioned to be advanced toward the head 1200 of the stapler for sequential discharge. The channel 1460 provides a guided path for the staples 1430, ensuring that they remain properly aligned and are smoothly advanced by the pusher mechanism 1410.

The rear end of the cartridge 1400 is connected to the pusher mechanism 1410, which is driven by a spring 1420. This spring 1420 is pre-loaded to apply continuous pressure to the pusher mechanism 1410, thereby advancing the staples 1430 forward through the channel 1460 toward the discharge point at the head 1200. The pusher mechanism 1410 ensures that each staple 1430 is properly positioned for engagement and discharge with every actuation of the lever arm 1310. In the shown embodiment, the pusher comprises an angled side adapted to bear against the one or more staples at a front side and joined to a spring cartridge at a rear end.

In some embodiments, the staple cartridge 1400 may be refillable, allowing individual staples 1430 to be manually inserted into the channel 1460 as needed. Alternatively, the cartridge 1400 may be entirely replaced with pre-loaded cartridges. The staples 1430 within the cartridge 1400 are composed of hypoallergenic and heat-resistant materials, such as titanium or copper alloy. The staples 1430 are shaped as an open "C" configuration and are designed to deform into a closed "O" shape upon contact with the anvil 1480, thereby securely fastening the weft hair extension to the natural hair.

In one configuration, the staples are initially shaped as an open "C," which transitions to a closed "O" shape when pressed against the anvil. However, other staple shapes can be utilized depending on the application. For example, staples may be formed in a "U" shape, with legs that crimp inward, or in a "V" shape, which collapses to create a tighter grip on thicker weft extensions. The dimensions of the staples can also vary to suit different hair types and weft materials. Thicker staples may be used for denser or coarser hair, while smaller, thinner staples may be ideal for finer or more delicate hair types. Staple tips can also differ, with pointed tips for easier penetration or rounded tips to minimize scalp irritation. In one embodiment, the tips are needle-like to minimize hair damage during the installation thereof. In one embodiment, the staple tips are folded over each other to form a closed ring with overlapping tips that are slightly offset. In another embodiment, the staple tips include a recessed area on opposing inside and outside regions, such that as the tips are closed, the tip of the opposing end is received within the recessed region. In this way, they nest with each other to form a torus shape with a substantially coextensive exterior.

Figure 6:
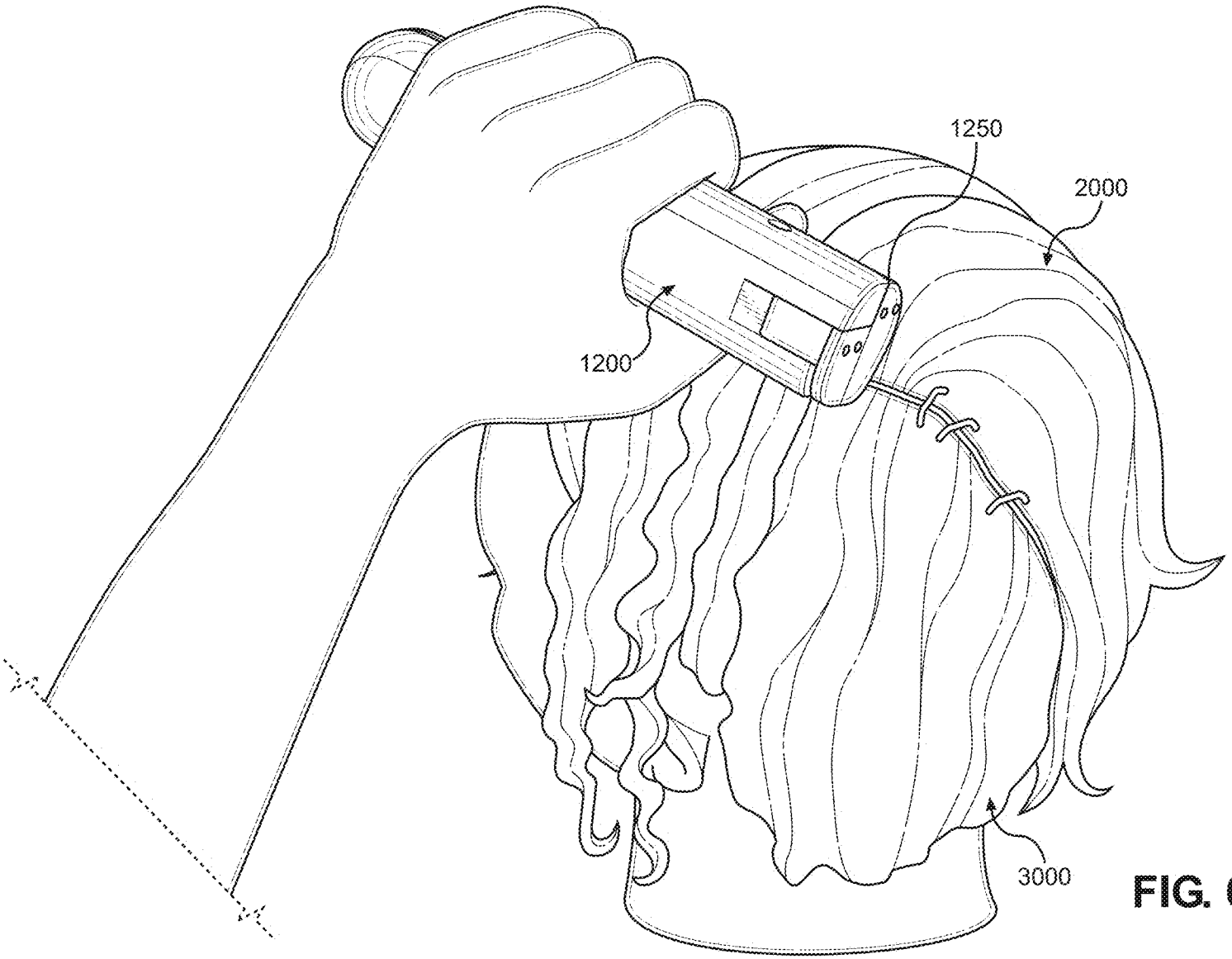
FIG. 6 shows a perspective view of one embodiment of the staple cartridge of the hair extensions stapler in use.

Referring now to FIG. 6, there is shown a perspective view of the hair extensions stapler in use. This figure illustrates an exemplary application of the stapler, where it is utilized to secure a weft hair extension to natural hair. The process involves positioning the weft hair extension and natural hair within the collection area 1250 of the head 1200 and discharging a staple 1430 to fasten the extension securely.

In one exemplary method of use, the staple cartridge 1400 is loaded into the cartridge receiving compartment 1450 of the stapler housing 1100. The staple cartridge 1400 is preloaded with multiple staples 1430, which are arranged in a linear configuration along the channel 1460. Once inserted, the spring 1420 in the pusher mechanism 1410 applies constant pressure, advancing the staples 1430 toward the head 1200 in preparation for discharge. The natural hair 2000, typically styled in cornrows or plait, and the weft hair extension 3000 are positioned within the collection area 1250 of the head 1200. The opposing faces 1251 and 1252 of the collection area guide the hair into place, ensuring proper alignment between the natural hair and the weft extension. This funneling mechanism allows for precise and consistent stapling by isolating the hair to be stapled from the rest, which minimizes misalignment during operation.

Once the hair is properly positioned, the user grips the handle 1300 and applies pressure to the lever arm 1310. This action actuates the stapler, engaging the internal mechanism that advances a staple 1430 from the cartridge 1400 toward the anvil 1480 located in the head 1200. The staple, initially shaped as a "C," is pressed against the anvil, deforming into a closed "O" shape. The staple secures the weft hair extension 3000 to the natural hair 2000. The spring mechanism 1350 in the handle 1300 automatically returns the lever arm 1310 to its original position after actuation, allowing the stapler to be immediately ready for reuse. The stapling process is repeated along the length of the cornrow or hair section as needed. The pusher mechanism 1410 continues to advance new staples 1430 into position for discharge, ensuring that the stapler operates smoothly without requiring manual reloading after each staple is applied.

If removal of the extension becomes necessary, a staple removal tool can be used to safely disengage the staples 1430 without causing damage to the natural hair or the weft extension. The tool is specifically designed to interface with the closed staples, providing a simple and efficient method for removing the attached wefts without cutting or damaging the hair.

In one embodiment, the stapler includes a tension control mechanism (shown in FIG. 2) is configured to adjust the force required to actuate the stapler. In this way, the tension control mechanism allows the user to selectively modify the tension settings to apply more or less pressure as needed during the stapling process.

In another embodiment, the opposing faces 1251 and 1252 of the collection area 1250 are coated with a soft, gel-like material. This cushioning layer serves to protect the user's natural hair during the stapling process by minimizing friction and reducing the risk of scalp irritation or hair damage.

In one embodiment, the stapler comprises a viewing window positioned along the cartridge receiving compartment configured to allow a user to monitor the remaining staple count.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair extensions stapler, comprising:

a housing having a head at a first end and a handle at a second end;

wherein the head comprises a collection area configured to receive hair therebetween;

a handle having a first lever arm configured to actuate via a squeezing force bearing thereagainst;

a cartridge receiving compartment configured to receive a cartridge therein;

the cartridge comprising:

one or more staples disposed in linear arrangement within a channel and adapted to advance into the head via a pusher, wherein the one or more staples are held at an angled orientation with the pointed ends of the staples facing the first end of the housing;

the pusher comprising an angled side adapted to bear against the one or more staples at a front side and joined to a spring cartridge at a rear end, wherein the angled side of the pusher matches the angle of the staples in the cartridge and maintains the one or more staples in the angled orientation during advancement toward the head;

wherein the cartridge spring is joined to the pusher and a fixed member, and is configured to push the one or more staples towards an anvil;

the anvil configured to receive a first staple from the one or more staples stored in the cartridge;

wherein the first staple is adapted to transition from an open position to a closed position upon actuation of the handle;

wherein upon actuation of the handle, the first staple is advanced against the anvil via a driver to close the first staple from the open position to the closed position and dispense the first staple to the hair positioned within the collection area;

wherein the one or more staples are angled towards the first end, and the first staple is closed and dispensed in a path perpendicular to the hair positioned within the collection area.

2. The hair extensions stapler of claim 1, wherein the handle further comprises a spring mechanism configured to automatically return the lever arm to its original position after each actuation.

3. The hair extensions stapler of claim 1, wherein the pusher mechanism is biased by a pre-compressed spring, positioned to provide constant tension, and is configured to continuously advancing the staples toward the head for sequential discharge upon actuation of the lever arm.

4. The hair extensions stapler of claim 1, wherein the cartridge is removably inserted into the cartridge receiving compartment.

5. The hair extensions stapler of claim 1, wherein the anvil comprises a contoured surface configured to deform the first staple from an open "C" shape into a closed, continuous "O" shape upon actuation of the handle upon discharge.

6. The hair extensions stapler of claim 5, wherein the closed "O" shape is formed by the tips of the first staple nesting with each other to form a torus shape with a substantially coextensive exterior.

7. The hair extensions stapler of claim 1, wherein the first staple is configured to fully encircling the hair positioned withing the collection area.

8. The hair extensions stapler of claim 1, wherein the one or more staples are composed of materials selected from titanium and/or copper alloy.

9. The hair extensions stapler of claim 1, wherein the head comprises a pair of faces that form the collection area, the pair of faces are coated with a soft friction-reducing material configured to minimize friction and reduce a risk of scalp irritation during stapling process.

10. The hair extensions stapler of claim 1, wherein the cartridge is configured to hold up to 75 staples.

11. The hair extensions stapler of claim 1, wherein the handle further comprises an adjustable tensioning mechanism comprising a rotatable dial operably connected to a spring to adjust a compression force thereof, the adjustable tensioning mechanism configured to adjust the force required for stapling.

12. The hair extensions stapler of claim 1, wherein the staples are coated with a hypoallergenic material that reduces irritation to a scalp when in contact with skin.

* * * * *